United States Patent [19]

Pinto et al.

[11] Patent Number: 4,864,693

[45] Date of Patent: Sep. 12, 1989

[54] FLOW-THROUGH FIBER PREPARATION FEED SYSTEM AND METHOD

[75] Inventors: Akiva Pinto, Dusseldorf; Guenter Lucassen, Haltern; Bernhard Bocht, Neubulach, all of Fed. Rep. of Germany

[73] Assignee: Hergeth Hollingsworth GmbH, Duelman, Fed. Rep. of Germany

[21] Appl. No.: 252,191

[22] Filed: Sep. 30, 1988

[51] Int. Cl.[4] ..... D01G 15/40

[52] U.S. Cl. ..... 9/105; 19/300

[58] Field of Search ..... 19/105, 64.5, 300

[56] References Cited

U.S. PATENT DOCUMENTS

| | | | |
|---|---|---|---|
| 3,414,330 | 12/1968 | Trützschler | 19/105 X |
| 4,404,710 | 9/1983 | Wood | 19/300 X |
| 4,476,611 | 10/1984 | Keller et al. | 19/98 X |
| 4,514,881 | 5/1985 | Hergeth el al. | 19/80 R |
| 4,682,388 | 7/1987 | Pinto | 19/105 |

FOREIGN PATENT DOCUMENTS

| | | | |
|---|---|---|---|
| 1544813 | 4/1979 | United Kingdom | 19/105 |
| 2127446 | 4/1984 | United Kingdom | 19/105 |

*Primary Examiner*—Werner H. Schroeder
*Assistant Examiner*—Sara M. Current
*Attorney, Agent, or Firm*—Cort Flint

[57] ABSTRACT

A textile fiber preparation feed system and method are disclosed in which processed textile fibers from a blender (A) are delivered to a flow-through textile cleaner (B) and then directed to a vertical chute feed (C). An air stream conveys the fibers from blender (A) to chute feed (C) across cleaning rollers (34, 36) of cleaner (B) without a nip feed providing increased cleaning efficiency. Control system (60) continues operation of top feed roll (52) after termination of carding machine (14) and discharge of fiber batt (12) from the chute feed to purge excess fibers in the air stream. In this manner, accumulation of the excess fibers in a fiber column (F) above top feed roll is prevented which would block air exit (50) and choke down top feed roll (52) upon resumption of the carding machine or fiber batt discharge.

10 Claims, 1 Drawing Sheet

FLOW-THROUGH FIBER PREPARATION FEED SYSTEM AND METHOD

BACKGROUND OF THE INVENTION

The invention relates to a system and method for preparing and feeding cleaned textile fibers to associated textile machinery in which a flow-through air stream conveys fibers through a cleaner with increased cleaning efficiency directly into a vertical chute feed.

In numerous processes involving textile fibers preparatory to making woven or non-woven textile fabrics, the fibers are opened, cleaned, and blended in various steps and combinations. These operations are carried out in an area of a mill commonly referred to as a "blowroom" because fibers are conveyed by an airflow caused by one or more transport blowers. In certain fiber processes it is typical to feed fibers vertically by means of a vertical chute feed. A typical vertical chute feed is disclosed in U.S. Pat. No. 4,476,611 having a batt formation chute section in which fibers fed in a column are compacted and densified into a fiber batt. The fiber batt is then discharged from the vertical chute feed to an associated machine a carding machine or other processing machine. This type of vertical chute feed typically includes a transition or reserve section on top of the formation chute section. Fibers are delivered by a fiber-laden airflow horizontally into the reserve section. The air exits the reserve section whereby fibers are deposited in a column above a top feed roll which feeds the fibers into the formation chute section. Fibers are typically cleaned and fed into the airflow air stream by a flock feeder, for example, as shown in U.S. Pat. No. 4,682,388. The fibers are fed from the flock feeder to the vertical chute feed. The flock feeder includes a pair of feeder rolls having a nip between which the fibers are fed onto an apron which delivers the fibers into the fiber-laden air stream to the reserve section of the chute. The amount of fibers fed to the transition section is determined by sensing air pressure in the supply duct leading to the reserve section. Fibers accumulate in the reserve section, the pressure increases. This is because an air exit arranged across a wall of the reserve section becomes more or less blocked with fibers so that the air pressure changes accordingly. U.S. Pat. No. 4,682,388 disclosed such a feed and control system. This change in air pressure is used to sense the quantity of fibers and control the feed rolls of the flock feeder to adjust the fiber supply accordingly. The feed roller of the cleaner provides a nip feed which can stop and start the supply of fibers in a positive manner without any time lag, i.e. the supply or nonsupply of fibers is relatively instantaneous. When the carding machines stop, the supply of fibers is stopped so that the controlled quantity of fibers in the reserve section remains relatively level and equal to that desired. Generally, a quantity of fibers is desired which corresponds to a level leaving a part of the air exit unblocked. The escape of air is necessary to prevent applying too much pressure on the fiber column in the reserve and loading down and choking of the feed roll.

Fiber cleaning machines without a nip are known wherein fibers are drawn across fiber cleaning and opening rollers solely by a flow-through airflow. A flow-through fiber cleaner is manufactured by Hergeth Hollingsworth GmbH of Duelmen, W. Germany under the designation WRZ type roller cleaner. This roller cleaner is particularly suitable for cleaning different kinds of very trashy cotton and is mainly used as a first cleaning machine within a cleaning line. Flow-through cleaners are conventionally placed between a bale opening machine and the blending station within a blowroom line. This type cleaner has very good cleaning efficiency and opening characteristics. The fiber material is drawn through a pair of rollers axially and exits the cleaning machine on the other side while all of the time being contained by the fiber-laden airflow. However, there is no nip feed in the flow-through cleaner to control and prevent excess fiber accumulation in the reserve section when it is desired to stop the feeding operation. Excess fibers contained in the airflow lines would be deposited in the reserve section which could choke the tip feed roll down. Because there is a need to feed vertical chute feeds with cleaners having nip feeds, the flow-through type cleaners have not been used to feed vertical chute feeds.

Accordingly, an important object of the invention is to provide a textile fiber preparation feed system having increased cleaning efficiency for feeding fibers to a vertical chute feed.

Another object of the invention is to provide a textile fiber preparation and feed system for feeding fibers to a vertical chute feed using a flow-through fiber cleaner which feeds fibers directly to the chute feed.

Another object of the invention is to provide a method for cleaning and feeding cleaned fibers to a vertical chute feed using a flow-through fiber cleaner having increased efficiency.

Another object of the invention is to provide a system and method for feeding cleaned fibers to a vertical chute feed by means of a flow-through cleaner without depositing excess fibers contained in the flow-through air stream into the chute feed upon ceased demand for fiber discharge from the chute.

Another object of the invention is to provide a method and system for feeding fibers to a vertical chute feed directly from a flow-through type cleaner in which control of the system is had in such a manner that excessive fibers contained in the flow-through air stream are compensated for when a carding machine fed by the chute feed is stopped to prevent choking of the chute feed roll when carding is resumed.

SUMMARY OF THE INVENTION

In a textile fiber preparation and delivery system, the improvement comprising in combination; a vertical chute feed having a batt formation section for forming and discharging a densified fiber batt; a top feed roll which feeds fibers to a formation section; a reserve section disposed above a top feed roll from which a fibers are fed by a top feed roll into a batt formation section, a reserve section including an elongated air exit formed across a width of a section in a side wall of a reserve section through which air may escape from a fiber-laden airflow which delivers fibers into a reserve section and deposits fibers in a fiber column housing a profile across an air exit, a flow-through fiber cleaner having a housing in which a pair of fiber cleaning rollers are carried across which fibers are conveyed by a fiber-laden airflow without a nip feed through a cleaner housing for cleaning and opening of fibers, a flow-through cleaner having a cleaner inlet through which an airflow enters a cleaner and a cleaner outlet though which a airflow exits a cleaner, a cleaner inlet being connected to a source of fibers and a cleaner outlet being connected to a reserve section of a vertical chute feed, and blower means for delivering fibers by means of a fiber-laden airflow from a fiber source, through a flow-through fiber cleaner, and into a reserve section.

An air stream duct means connecting a source of fibers to a cleaner inlet and for connecting a cleaner outlet to a reserve section; and control means for controlling an amount of fiber supplied by a fiber source in response to a function of the quantity of fibers in a reserve section, a control means controlling the operation of a top feed roll in response to a level of fibers present in a fiber batt formation section and wherein a control means continues operation of a top feed roll after discharge of a fiber batt has terminated to purge excess fibers stored in a air stream duct extending from a fiber source to reserve section and prevent blocking of an air exit of a reserve section to thereby prevent choking of a top feed roll upon resumption of a fiber batt discharge.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
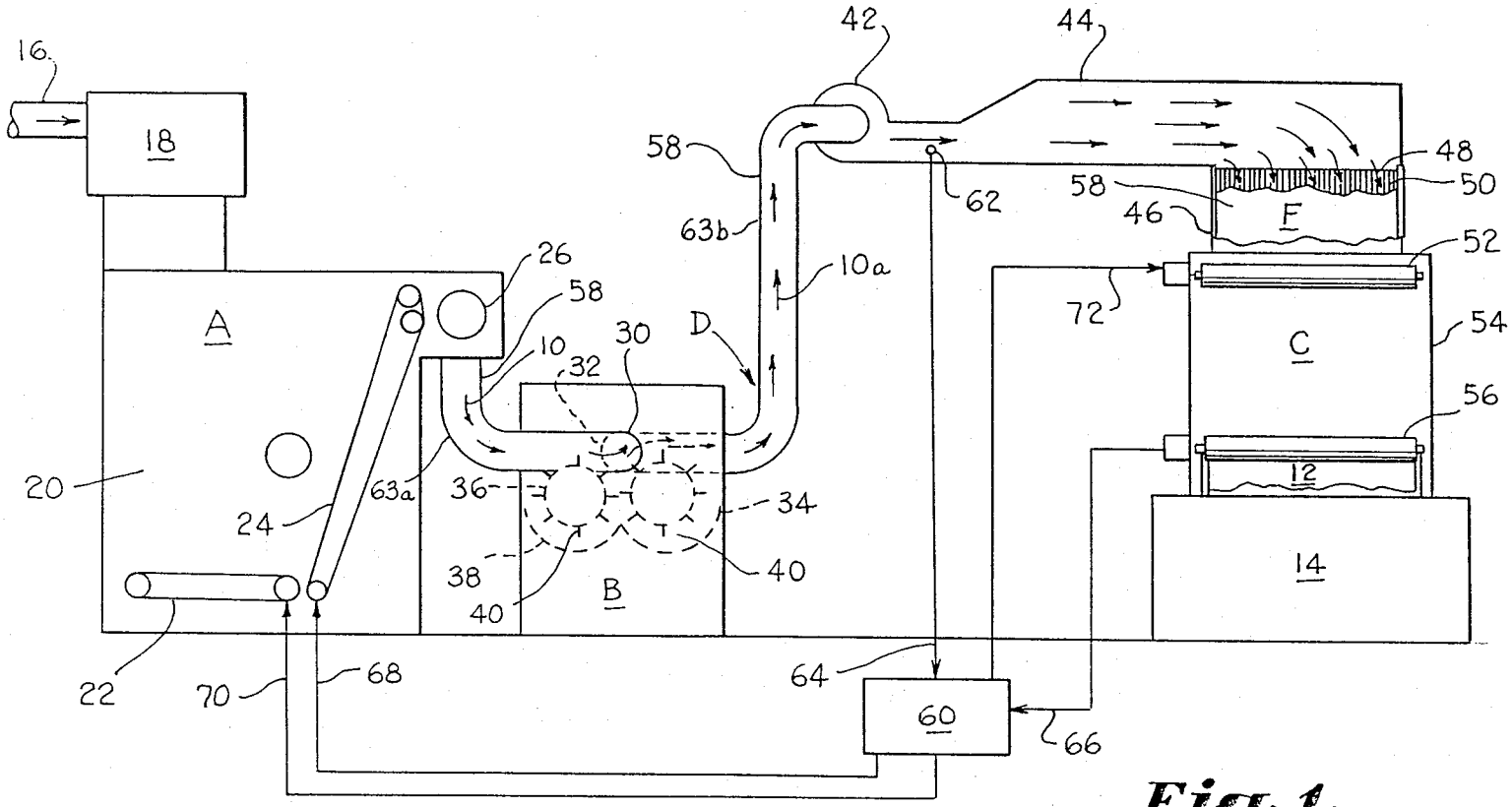
FIG. 1 is a schematic illustration of a textile fiber preparation and feeding system using a flow-through fiber cleaner according to the invention.

Referring now in more detail to the drawings, a lay down cross blender is illustrated at A which provides a source of blended fibers. Fibers are delivered in the form of a fiber-laden airflow 10 from the blender to a flowthrough fiber cleaner B. The fibers are transported through cleaner B in the airflow without a nip feed directly to a vertical chute feed C. Fibers are compacted in the vertical chute feed and discharged in the form of a densified fiber batt 12 which are fed to an associated carding machine 14.

Lay down cross blender A provides effective blending at this stage of fiber processing. Blending is one of the initial processes of fiber preparation which serves for homogenization and intensification of tuft blends, compensation of material density variations, and equalization of differences in material humidity. Fibers may be supplied to the blender with a conventional or an automatic bale opening system such as that disclosed in U.S. Pat. No. 4,514,881. Fibers enter the blender from the fiber bale opening system at inlet 16. 16 is the entrance to a traversing air fiber separator 18 which conventionally traverses at right angles to the direction in which the fiber flows through the blender. The traversing action of the separator evenly distributes the separated fibers in layers across the entire working width of the blender. The density of the fibers in a blending compartment 20 of the blender may be accurately controlled by photoelectric cells in a compacting roll (not shown) in a conventional manner. The layers of fibers are carried forward on an apron 22 in the blender and are presented to a spiked lattice 24 which removes the fibers from the cross section of the layer and carries them forward to a stripper roll 26 from which the fibers are conveyed by fiber-laden airflow 10 to cleaner B. A suitable lay down cross blender is manufactured by Hergeth Hollingsworth GmbH of Duelmen, W. Germany under the designation LCB type blender. This blender is a processing machine. :for natural fibers and man-made fibers as well with a staple length of up to 120 mm.

Referring now in more detail to the invention, flow-through cleaner B is placed between the blender, or other fiber source, and vertical chute feed C. Cleaner B includes a cleaner inlet 30 on one side of the cleaner and a cleaner outlet 32 on the opposite side of the cleaner. While any suitable flow-through cleaner without a nip feed for conveying the fibers through the cleaner may be utilized, one particularly advantageous cleaner is a WRZ roller cleaner manufactured by Hergeth Hollingsworth of Duelmen, W. Germany. Only so much of this cleaner as is necessary to an understanding of the present invention is illustrated. The cleaner includes a pair of fiber opening and cleaning rollers 34 and 36. Fibers are conveyed by means of fiber-laden airflow 10 axially along the length of the rollers which are driven rapidly in rotation. Waste from the opening rollers falls through a screen 38 into a bottom compartment of the cleaner where it may be conveyed away by suction. The rollers are continuously rotated while the fibers are conveyed across the opening rollers. The opening rollers 34 and 36 have pins 40 which extend radially outward. The opening pins gently clean the cotton as it flows through the cleaner. Since the cleaning rollers are continuously rotated, the cleaner has a high fiber through-put and cleaning efficiency as opposed to the nip type fiber feeder found in the typical flock feeder. A transport blower 42 generates the fiber-laden airflow. The fiber-laden airflow 10*a*, which exits flow-through cleaner B, contains opened, cleaned fibers which have been cleaned with a high efficiency. The cleaned fiber airflow 10a enters an inlet duct 44 of vertical chute feed. Vertical chute feed C includes reserve section 46 which receives the fibers with the air from the fiber-laden airflow exiting in the direction of arrows 48 through an air exit 50 formed in a back wall of the section. Air exit 50 may include a reed type plate through which the air exits. As the air leaves the reserve section, fibers F are deposited in the transition or reserve section above a top feed roll 52. Top feed roll 52 feeds fibers into a fiber batt formation section 54 which discharges the fibers in the form of a densified, compacted fiber batt 12. The fiber batt is discharged by delivery rolls 56. The workings of the formation chute 54 are conventional and are disclosed in detail in U.S. Pat. No. 4,476,611.

In typical operation, it becomes necessary to shut down carding machine 14 for various reasons, even on multiple occasions during a single day. Flow-through cleaner B produces increased through-put and increased cleaning efficiency for the fibers, but also produces excessive fibers in the duct system 58 between the source of fibers at blender A and the top feed roll 52 of vertical chute feed C. A control system 60 regulates the amount of fibers fed to reserve section 46. This is done by sensing pressure with a pressure sensor 62 which indicates the amount of fibers present in the reserve section. As fibers accumulate and cover air exit 50 more or less, the pressure fluxuates to indicate the quantity of fibers. A suitable control system is disclosed in U.S. Pat. No. 4,682,388, hereby incorporated herein, which controls the feeding of fibers to a vertical chute feed from a flock feeder. In this system, the control system regulates the operation the flock feeder feed rolls having a nip which controls the feed of fibers between the rollers. The supplied fibers may be regulated generally instantaneously without any real lag time in this manner. There is no problem of over supply of fibers to the double chute feed since there are very few fibers in the system when the supply is shut down. In the present invention, the flow-through conveyance system and machinery constitutes a much higher capacity system. In essence, there is a large store of fibers in the distribution systems during this period. In the event the carding machine is stopped, even if the feed stops in blender A, considerable quantity of fibers are present in the duct system which must be deposited into the reserve section. This could cause blocking of air exit 48. With air exit 48 sufficiently blocked, pressure can build up in the reserve section causing the top feed roll to choke down. This is due to the fact that air continues to blow down on the fibers causing them to become too dense and too heavy for the torque of the feed roll. In this condition, before the chute feed and/or carding machine can be started again, the top reserve section must be taken apart and cleaned out. The cleaning out process involves considerable amounts of time, labor, expense, and other detrimental conditions. In accordance with the present invention, this problem is avoided when a flow-through cleaner is used for a higher cleaning efficiency in combination with a vertical chute feed by programming control system 60 to continue operation of top feed roll 52 after carding machine 14 or fiber batt discharge is terminated. In this manner, the additional and excessive fibers contained in the flow-through system are compensated for by reducing the column of fibers deposited in the reserve section. In this manner, the excessive fibers present in the reserve section are compensated for upon carding machine stoppage. When operation of the carding machine is once again resumed, the chance that the air exit is blocked is essentially eliminated so that cleaning out of the reserve section is not necessary, even when using a flow-through cleaner. While the invention is illustrated with a carding machine, the advantages may be had with a vertical chute feed having a fiber batt discharge to other associated textile processing machinery, for example, a vertical chute on a Masterclean machine manufactured by Hergeth Hollingsworth GmbH of Duelmen, W. Germany.

Transport duct means D for transporting the fiber-laden airflow includes a first duct section 63*a* between blender A and cleaner B, and a second duct section 63*b* between cleaner B and reserve section 46.

In accordance with the invention, control means 60, which may be any classical program controller which may be programmed by one having skill in the art, receives pressure signals 62 at 64 and also receive a signal 66 from delivery roll 56 indicating that the carding machine and/or fiber batt discharge has terminated. Control means 60 has an output signal 68 which controls the operation of spiked lattice 24 in a conventional manner and an output signal 70 which controls the operation of apron 22 in a conventional manner. For example, both the spiked lattice and apron may be driven by regular speed DC electric motors which are controlled by the output from controller 60. In operation, when either termination of carding machine 14 or discharge of fiber batt 12 is detected, the supply of fibers from blender A is terminated by terminating the drive of spiked lattice 24 and apron 22. At the same time, rollers 34 and 36 continue to operate as well as blower 42 so that there are excess fibers present in the transport duct D extending all of the way from the fiber source A to vertical chute C. To purge these excess fibers, controller 60 delivers a signal 72 to top feed roll 52 to continue its operation for a prescribed length of time sufficient to purge excess fibers so that they do not build up and block air exit 50.

while a preferred embodiment of the invention has been described using specific terms, such description is for illustrative purposes only, and it is to be understood that changes and variations may be made without departing from the spirit or scope of the following claims.

What is claimed is:

1. In a textile fiber preparation and delivery system, the improvement comprising in combination; a vertical chute feed having a batt formation section for forming and discharging a densified fiber batt; a top feed roll which feeds fibers to said formation section; a reserve section disposed above said top feed roll from which said fibers are fed by said top feed roll into said batt formation section, said reserve section including an elongated air exit formed across a width of said section in a side wall of said reserve section through which air may escape from a fiber-laden airflow which delivers fibers into said reserve section and deposits said fibers in a fiber column having a profile across said air exit, a flow-through fiber cleaner having a housing in which a pair of fiber cleaning rollers are carried across which said fibers are conveyed by said fiber-laden airflow without a nip feed through said cleaner housing for cleaning and opening of said fibers, said flow-through cleaner having a cleaner inlet through which said airflow enters said cleaner and a cleaner outlet through which said airflow exits said cleaner, said cleaner inlet being connected to a source of fibers and said cleaner outlet being connected to said reserve section of said vertical chute feed, and blower means for delivering fibers by means of said fiber-laden airflow from said fiber source, through said flow-through fiber cleaner, and into said reserve section.

2. The system of claim 1 including control means for controlling an amount of fibers supplied by said fiber source in response to a function of the quantity of fibers in said reserve section, said control means controlling the operation of said top feed roll in response to a level of fibers present in said fiber batt formation section, and wherein said control means continues operation of said top feed roll for a prescribed period of time after termination of the discharge of said fiber batt from said batt formation section to purge excess fibers contained in said fiber-laden airflow and said flow-through fiber cleaner and prevent over filling said reserve section and blocking of said air exit to prevent choking of said top feed roll upon resumption of said feed chute and said fiber batt discharge.

3. The system of claim 1 including air stream duct means connecting said source of fibers to said cleaner inlet and for connecting said cleaner outlet to said reserve section; and control means for controlling an amount of fibers supplied by said fiber source in response to a function of the quantity of fibers in said reserve section, said control means controlling the operation of said top feed roll in response to a level of fibers present in said fiber batt formation section and wherein said control means continues operation of said top feed roll after discharge of said fiber batt has terminated to purge excess fibers stored in said air stream duct means extending from said fiber source to said reserve section to prevent blocking of said air exit of said reserve section to thereby prevent choking of said top feed roll upon resumption of said fiber batt discharge.

4. A system for preparing and feeding textile fibers for processing on a carding machine comprising in combination:

supply means for supplying blended textile fibers;

pneumatic means for conveying said fibers in a fiber-laden airflow;

a flow-through fiber cleaner connected to said fiber source having a cleaner inlet through which said fiber-laden airflow enters into said cleaner, and having a cleaner outlet from which said fiber-laden airflow is delivered outwardly from said cleaner;

fiber cleaning means carried in said fiber cleaner, and fiber conveyance means for conveying said fibers from said cleaner inlet to said cleaner outlet through said cleaner consisting of said fiber-laden airflow for conveying said fibers through said fiber cleaner and across said fiber cleaning means without a nip feed;

a vertical chute feed having a fiber batt formation section and a reserve section, a top feed roll disposed between said reserve section and batt formation section for feeding fiber from said reserve section to said batt formation section, said reserve section having an air exit generally across the width of a portion of said reserve section through which air exits upon depositing fibers contained in said fiber-laden airflow into said reserve section above said top feed roll; and control means for continuing the operation of said top feed roll after termination of said fiber batt discharge and said supply means to purge excess fibers in said fiber-laden airflow and reduce blockage of said air exit by said excess fibers and prevent said top feed roll from choking down on the resumption of said vertical chute feed.

5. The system of claim 4 wherein said fiber cleaner includes a pair of cleaning rollers, and said flow-through of air is directed axially along the length of said cleaning rollers as it travels from said cleaner inlet to said cleaner outlet.

6. A method of increasing the cleaning efficiency of a textile fiber preparation and feed system which supplies fibers to a vertical chute feed having a reserve section with an air exit, a batt forming section from which a compacted fiber batt is discharged, and a top feed roll carried between said reserve section and said batt forming section of feeding fibers into said batt forming section from said reserve section, said method comprising the steps of:

transporting textile fibers in a fiber-laden airflow from a fiber source to said vertical chute feed;

placing a flow-through fiber cleaner between said fiber source and said vertical chute feed;

transporting said fibers from said source, to said fiber cleaner by said fiber-laden airflow without using a nip feed;

cleaning said fibers by transportation in said fiber-laden airflow directly through said flow-through cleaner;

delivering said cleaned fibers directly to said vertical chute feed.

7. The method of claim 6 including terminating said fiber batt discharge of said vertical chute feed; and purging excess fibers in said chute feed upon termination of said discharge from said chute feed to prevent choking down of said top feed roll upon start-up.

8. The method of claim 7 including purging excess fibers contained in said fiber-laden airflow extending from said source to said reserve section after termination of discharge of said fiber batt from said chute feed by continuing the operation of said top feed roll after termination of said fiber batt discharge a sufficient period of time to prevent said excess fibers from blocking said air exit of said reserve section.

9. A method of constructing a textile fiber preparation feed system which feeds textile fibers to a vertical chute feed having a reserve section with an air exit, a batt forming section from which a compacted fiber batt is discharged, and a top feed roll carried between said reserve section and batt forming section for feeding said fibers into said batt forming section from said reserve section, said method comprising:

supplying fibers from a textile fiber blender which homogenizes and intensifies said fibers;

connecting a flow-through fiber cleaner directly to said fiber blender;

connecting said flow-through fiber cleaner to said reserve section of said vertical chute feed;

connecting said blender, flow-through fiber cleaner, and reserve section with a fiber-laden air stream distribution system; and transporting said fibers in said fiber-laden air stream from said textile blender through said flowthrough fiber cleaner, and to said reserve section without a nip fed.

10. The method of claim 9 including controlling the operation of said top feed roll of said vertical chute feed to continue the feeding of fibers of said reserve section to said formation section after said discharge of said fiber batt and said supply of blended textile fibers are terminated to purge excess fibers in said air stream distribution system and prevent blocking of said air exit in said reserve section.

* * * * *